United States Patent [19]

Brüstle

[11] Patent Number: 4,938,609

[45] Date of Patent: Jul. 3, 1990

[54] PULL-OUT GUIDE ASSEMBLY FOR DRAWERS

[75] Inventor: Klaus Brüstle, Lauterach, Austria

[73] Assignee: Julius Blum Gesellschaft m.b.H., Höchst, Austria

[21] Appl. No.: 383,157

[22] Filed: Jul. 19, 1989

[30] Foreign Application Priority Data

Jul. 29, 1988 [AT] Austria ..... 1927/88

[51] Int. Cl.[5] ..... F16C 29/10; A47B 88/00

[52] U.S. Cl. ..... 384/21; 312/348; 384/19

[58] Field of Search ..... 384/21, 19, 18; 312/348

[56] References Cited

U.S. PATENT DOCUMENTS

| | | | |
|---|---|---|---|
| 4,304,449 | 12/1981 | Litchfield | 384/19 X |
| 4,692,035 | 9/1987 | Röck et al. | 384/21 X |
| 4,728,200 | 3/1988 | Röck et al. | 384/19 |

FOREIGN PATENT DOCUMENTS

| | | | |
|---|---|---|---|
| 386734 | 3/1988 | Austria . | |
| 2927611 | 1/1981 | Fed. Rep. of Germany | 312/348 |
| 3347540 | 7/1985 | Fed. Rep. of Germany | 312/348 |

*Primary Examiner*—Thomas R. Hannon

*Attorney, Agent, or Firm*—Wenderoth, Lind & Ponack

[57] ABSTRACT

A pull-out guide assembly for a drawer includes, at each side of the drawer, a supporting rail on the side of the body of an article of furniture, a pull-out rail fastened to the drawer and a center rail running between such two rails. Near its rear end the pull-out rail is provided with a stop member pushing against a runner roller of the center rail, when the drawer is being pulled out. To prevent the stop member from being lifted over the runner roller when the drawer is extracted in a rough manner, a slide member is provided above the stop member in a running flange of the pull-out rail. Such slide member, depending on its position, prevents or allows the pull-out rail to be lifted from the runner roller.

10 Claims, 2 Drawing Sheets

PULL-OUT GUIDE ASSEMBLY FOR DRAWERS

FIELD AND BACKGROUND OF THE INVENTION

The invention relates to a pull-out guide assembly for a drawer or the like.

Pull-out guide assemblies which comprise at each side of a drawer a supporting rail on the side of the body of an article of furniture, a center rail and a pull-out rail fastened to the drawer provide the advantage that the drawer can be fully extracted from the body of the article of furniture so that objects stored in the rear region of the drawer are more easily accessible. Such pull-out guide assemblies also frequently are used for suspended file arrangements. The three rails at each drawer side are provided with stop members which should prevent unintended extraction of the center rail from the supporting rail and of the pull-out rail from the center rail, which could cause the drawer to fall to the floor.

Published Austrian patent application No. A 2237/84 relates to this problem which occurs when the pull-out rail is in its fully extracted position. This problem is particularly caused by the fact that, when the article of furniture is being assembled, the pull-out rail is first fastened to the drawer and then together with the drawer is pivoted in a vertical plane to be engaged in the center rail. This engaging of the pull-out rail must obviously not be prevented by the stop member. Consequently, the stop member must be relatively small, and as a result the stop member at the pull-out rail may easily overrun a runner roller of the center rail when the drawer is too roughly extracted from the article of furniture. The above mentioned published application suggested for this purpose a locking member which is fittable onto the pull-out rail. It is a disadvantage of this construction that a separate part is required with respect to the pull-out guide assembly. Such part has to be mounted at the center rail when the pull-out rail has been engaged in the center rail. Disengaging of the pull-out rail and thus of the drawer is only possible after removal of such part. Handling of such part is complicated, and it is easily lost. In industry and commerce, storing of a separate part is always connected with increased expenditure and work.

SUMMARY OF THE INVENTION

It is therefore the object of the present invention to provide an improved pull-out guide assembly of the aforementioned kind and in particular to provide for quick engaging and disengaging of a locking means for the pull-out rails of the pull-out guide assembly.

According to the invention this is achieved in that a latch member is mounted on the pull-out rail in a slidable manner and is movable into a position preventing the pull-out rail from being lifted from the roller of the center rail or into a position at which such motion of the pull-out rail is not impeded.

It is advantageously provided that the latch member is formed by a slide member. The slide member is advantageously mounted in a slot in a horizontal running flange of the pull-out rail. In this arrangement, marginal flanges defining the slot may extend into lateral grooves formed in the slide member.

A particularly compact arrangement is obtained by adapting the slide member to project into a recess of the stop member which is arranged below the running flange of the pull-out rail. Due to the fact that the slide member is arranged close to the stop member, an advantageous distribution of forces is obtained when the stop member is, due to the extracting motion of the drawer, pressed upwardly by the runner roller.

To facilitate adjustment of the slide member, advantageously the front end of the slide member is provided with a corrugated or roughened portion.

Further, an embodiment of the invention provides that the slide member is made of a harder material than the stop member. This arrangement provides smooth braking of the pull-out guide assembly and, moreover, good sliding of the slide member at the center rail if the slide member grazes or contacts the center rail.

BRIEF DESCRIPTION OF THE DRAWINGS

In the following an embodiment of the invention will be described in more detail with reference to the accompanying drawings, in which.

DESCRIPTION OF THE PREFERRED EMBODIMENT

Figure 1:
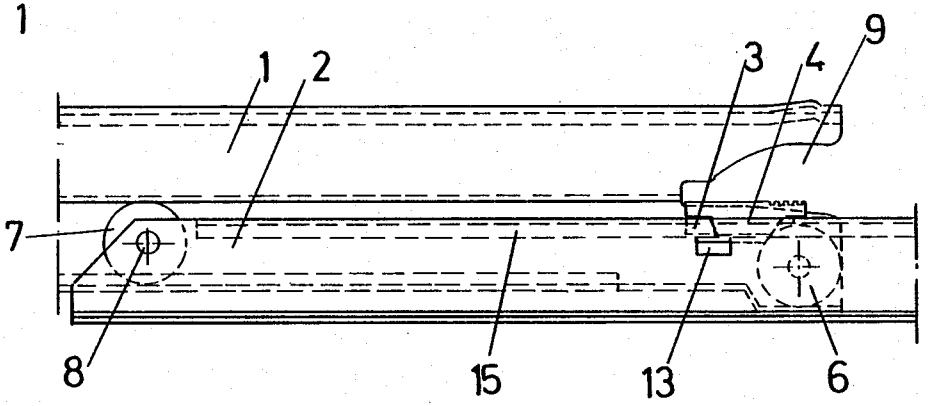
FIG. 1 is a side view of a center rail and of a pull-out rail, the pull-out rail being shown moved into a front end position, and of a slide member being shown disengaged.
Figure 2:
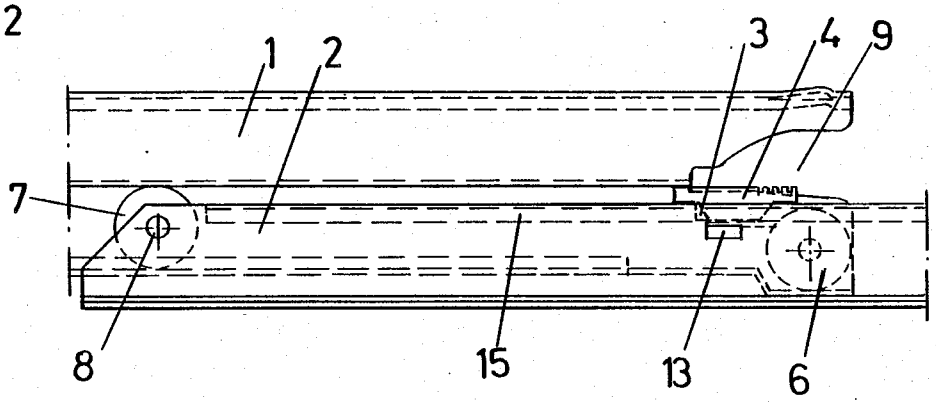
FIG. 2 is a view similar to FIG. 1, but with the slide member being shown engaged.
Figure 3:
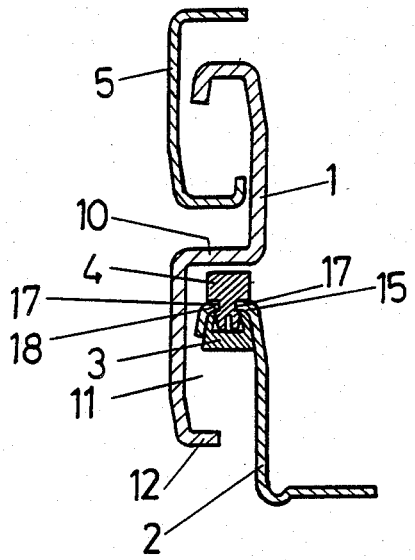
FIG. 3 is a transverse sectional view in the region of the slide member.

In the drawings, furniture components such as a side of a body of an article of furniture, a furniture side wall and a drawer are not shown, since they are made according to the state of the art and are not part of the present invention. FIGS. 1 and 2 each show only the front end of a center rail 1 and the rear end of a pull-cut rail 2 that supports one side of a drawer. FIG. 3 shows a supporting rail 5 to be attached to a side of a body of an article cf furniture.

The front end of center rail 1, of substantially S-shaped configuration, is provided with a runner roller 6, and the rear end of pull-out rail 2 is provided with a runner roller 7. Runner rollers 6, 7 are mounted by means of axles 8 to the rails 1, 2, i.e. they are mounted immovably with respect to rails 1, 2, and they are rot movable therealong as with a running carriage. At its front end, the center rail 1 is provided with a beak-like recess 9 which allows engaging of the pull-out rail 2. For this purpose, the runner roller 7 at the rear end of the pull-out rail 2 must be moved through the space between the runner roller 6 and the front end of a horizontal flange 10 of the center rail 1 into a running channel 11 which is formed between a lower horizontal flange 12 and the center flange 10 of the center rail 1.

Figure 4:
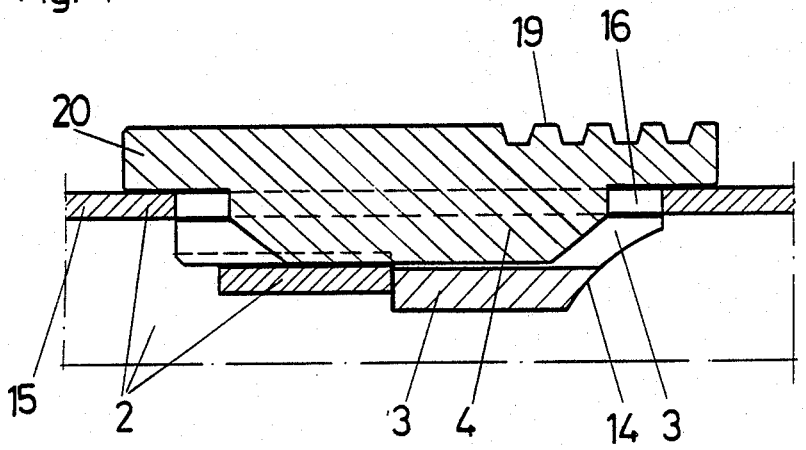
FIG. 4 is a longitudinal sectional view of the pull-out rail in the region of the slide member.

To prevent excessive extraction of the pull-out rail 2 from the center rail 1 when the drawer is pulled out, the pull-out rail is provided with a stop member 3 that is held by a flap 13 which is punched out of a lateral flange of the pull-out rail. The front end of flap 13 is provided with an inwardly curved stop surface 14 which abuts on the runner roller 6. As can be seen from FIGS. 3 and 4, stop member 3 is arranged immediately below a running flange 15 of the pull-out rail 2. In the region of the stop member 3, the pull-out rail 2 and the running flange 15 are provided with a slot 16. A latch member, in the form of a slide member 4, is mounted in the slot 16. Marginal flanges or edges 17 defining the slot 16 engage in grooves 18 formed in the slide member 4. Hence, slide member 4 is movable in opposite longitudinal directions relative to the pull-out rail 4. To facilitate moving of the slide member 4, it is provided at its front end with a corrugated or roughened portion 19.

When the slide member 4 is in its extreme front position within the limit of slot 16, which is shown in FIG. 1, it does not extend rearwardly as far as below the horizontal flange 10 of the center rail 1 when the stop member 3 is in contact with the runner roller 6. The pull-out rail 2 can therefore easily be lifted, whereby the stop member 3 is guided over the runner roller 6. Then the pull-out rail 2 can be further extracted from the center rail 1, and the runner roller 7 can be removed from the running channel 11 and pulled out between the horizontal flange 10 of the center rail 1 and the runner roller 6 of the center rail 1.

To secure the pull-out rail 2 in the center rail 1 and to prevent the stop member 3 from running over the runner roller 6, the slide member 4 is pushed into a rear position, i.e. to the extreme left as shown in FIG. 2. Thus, an extension 20 of slide member 4 projects below the horizontal flange 10 of the center rail 1 and is positioned between the running flange 15 of the pull-out rail 2 and the horizontal flange 10 of the center rail 1. Lifting of the pull-out rail 2 and overrunning of the runner roller 6 by stop member 3 is therefore impossible.

It is obvious that such locking means of the pull-out rail 2 can be easily engaged and disengaged by moving the slide member 4. Furthermore, it is impossible to lose the slide member 4 when the drawer and the pull-out rails 2 have been disengaged from the center rail 1.

What is claimed is:

1. A pull-out guide assembly for use on each of opposite sides of a drawer for guiding the movement of the drawer into and out of the body of an article of furniture, said assembly comprising:

a supporting rail to be mounted on a respective side of the body of the article of furniture;

a pull-out rail to be mounted on a respective side of the drawer, said pull-out rail including a horizontal running flange and a rear end;

a center rail having a forward end, a central horizontal flange and a lower vertical flange extending downwardly from said central horizontal flange, said center rail being mounted between said supporting and pull-out rails with said central horizontal flange above said running flange with a gap therebetween;

supporting rollers mounted on said rails for enabling relative longitudinal movement therebetween and including a first roller mounted on said lower vertical flange of said center rail adjacent said front end thereof for rolling contact with the lower surface of said horizontal running flange of said pull-out rail;

a recess formed in said front end of said center rail including said central horizontal flange thereof at a position above said first roller;

a stop member operable between said pull-out rail and said center rail for limiting the extent of longitudinal movement of said pull-out rail relative to said center rail in a direction of extraction of said pull-out rail from said center rail; and a latch member mounted on said pull-out rail for reducing the vertical dimension of said gap and to enable, when said pull-out rail is moved to a maximum extraction position relative to said center rail as limited by said stop member, said pull-out rail to be retained on or removed from said center rail, said latch member comprising a slide member mounted on said pull-out rail at a position to be adjacent said first roller and below said recess when said pull-out rail is in said maximum extraction position, said slide member being movable longitudinally relative to said pull-out rail between a removal position, whereat said pull-out rail may be lifted and withdrawn over said first roller from said center rail through said recess, and a retaining position, whereat said slide member blocks or restricts said recess to prevent lifting and withdrawal of said pull-out rail over said first roller from said center rail through said recess.

2. An assembly as claimed in claim 1, wherein said slide member is mounted in a slot formed in said running flange of said pull-out rail.

3. An assembly as claimed in claim 2, wherein marginal flanges of said pull-out rail defining said slot extend into lateral grooves formed in said slide member.

4. An assembly as claimed in claim 2, wherein said stop member is mounted below said running flange of said pull-out rail.

5. An assembly as claimed in claim 4, wherein said slide member extends through said slot into a recess formed in said stop member.

6. An assembly as claimed in claim 1, wherein said slide member has at a front end thereof a roughened portion to facilitate movement thereof relative to said pull-out rail.

7. An assembly as claimed in claim 1, wherein said slide member is made of a material that is harder than said stop member.

8. An assembly as claimed in claim 1, wherein said stop member is on said pull-out rail and abuts said first roller to define said maximum extraction position.

9. An assembly as claimed in claim 8, wherein said stop member has a curved forward end to abut said first roller.

10. An assembly as claimed in claim 1, further comprising a second roller mounted on said pull-out rail at said rear end thereof, and wherein said slide member, when in said removal position thereof, enables said second roller to be lifted over said first roller and withdrawn through said recess.

* * * * *